United States Patent [19]

Scott et al.

[11] 4,182,256

[45] Jan. 8, 1980

[54] AUTOMATIC TAKEOFF CONTROLLER FOR HYDROFOIL CRAFT

[75] Inventors: John H. Scott, Issaquah; Arlyn O. Harang, Seattle, both of Wash.

[73] Assignee: The Boeing Company, Seattle, Wash.

[21] Appl. No.: 388,429

[22] Filed: Aug. 15, 1973

[51] Int. Cl.[2] ..... B63B 1/18; B63B 1/22

[52] U.S. Cl. ..... 114/282; 318/588; 114/276; 114/281

[58] Field of Search ..... 114/66.5 H, 282 R; 235/150.2; 244/77 D, 77 E, 77 G, 77 M; 318/564, 584, 588

[56] References Cited

U.S. PATENT DOCUMENTS

| | | | |
|---|---|---|---|
| 3,137,260 | 6/1964 | Harris et al. | 14/66.5 H |
| 3,156,209 | 11/1964 | Ask | 114/66.5 H |
| 3,175,526 | 3/1965 | Johnson et al. | 114/66.5 H |
| 3,191,567 | 6/1965 | Ask | 114/66.5 H |
| 3,465,704 | 9/1969 | Baker | 114/282 |

*Primary Examiner*—Samuel W. Engle
*Assistant Examiner*—Thomas H. Webb
*Attorney, Agent, or Firm*—Thomas H. Murray

[57] ABSTRACT

An automatic takeoff control system for hydrofoil craft characterized in that the control surfaces of the craft are caused to automatically assume predetermined positions during takeoff, obviating the necessity for special levers, lever settings and special operator procedures which were involved in making a transition from hull-borne to foil-borne operation in accordance with prior art techniques.

4 Claims, 3 Drawing Figures

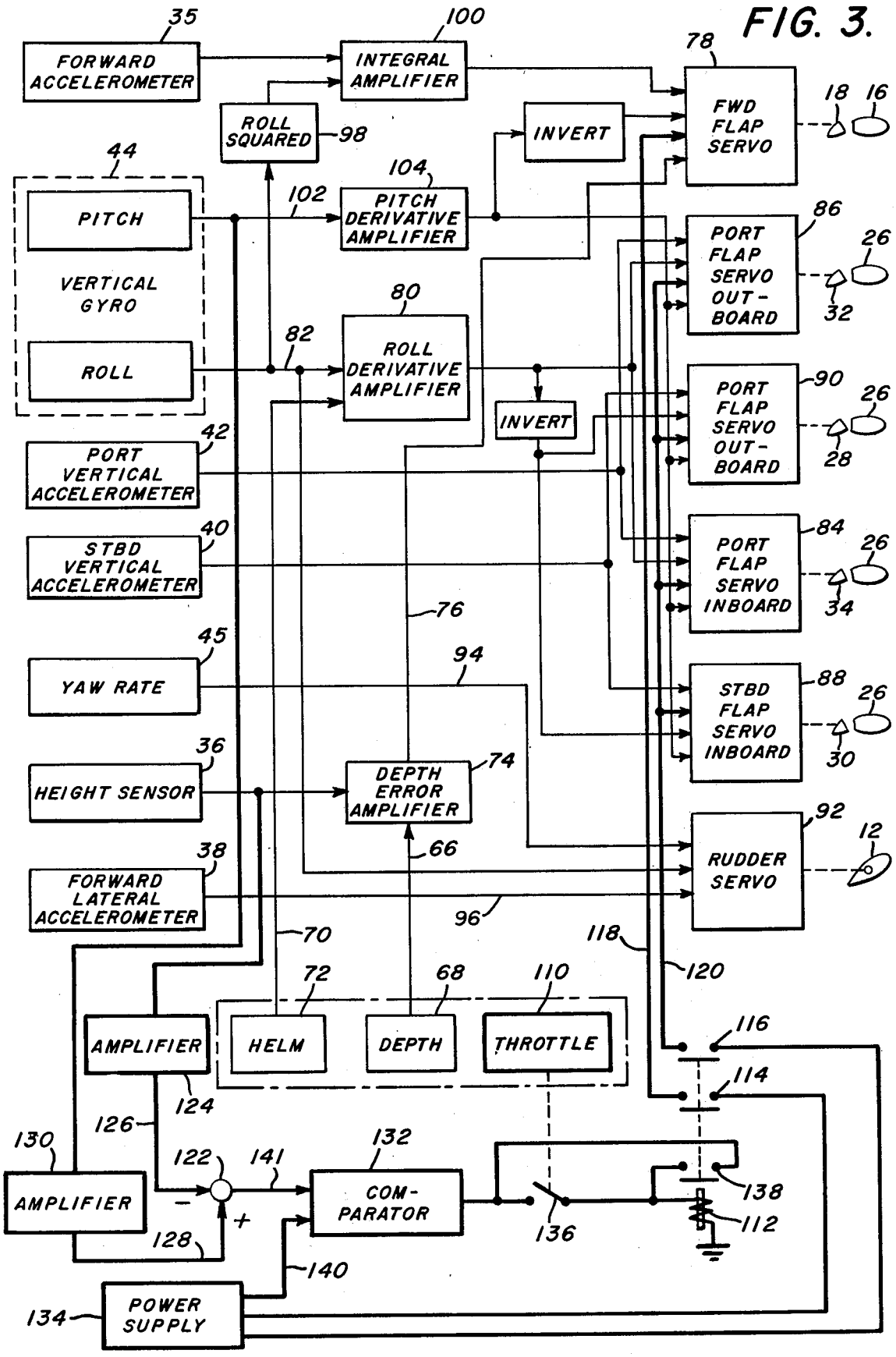
FIG. 3.
FORWARD ACCELEROMETER
35
INTEGRAL AMPLIFIER
100
ROLL SQUARED
98
INVERT
FWD FLAP SERVO
78
18
16
44
PITCH
VERTICAL GYRO
ROLL
102
PITCH DERIVATIVE AMPLIFIER
104
PORT FLAP SERVO OUT-BOARD
86
26
32
80
82
ROLL DERIVATIVE AMPLIFIER
INVERT
PORT FLAP SERVO OUT-BOARD
90
26
28
PORT VERTICAL ACCELEROMETER
42
STBD VERTICAL ACCELEROMETER
40
PORT FLAP SERVO INBOARD
84
26
34
76
YAW RATE
45
94
STBD FLAP SERVO INBOARD
88
26
30
HEIGHT SENSOR
36
DEPTH ERROR AMPLIFIER
74
66
RUDDER SERVO
92
12
FORWARD LATERAL ACCELEROMETER
38
96
70
118
120
72
68
110
AMPLIFIER
HELM
DEPTH
THROTTLE
116
114
124
126
130
122
141
132
AMPLIFIER
COM-PARATOR
138
112
136
128
140
134
POWER SUPPLY

AUTOMATIC TAKEOFF CONTROLLER FOR HYDROFOIL CRAFT

ORIGIN OF THE INVENTION

The invention described herein was made in the performance of a Government Contract with the United States Department of the Navy.

BACKGROUND OF THE INVENTION

As is known, in a hydrofoil seacraft, the hull of the craft is liftd out of the water by means of foils which are carried on struts and usually pass through the water beneath the surface thereof. In passing through the water, and assuming that sufficient speed is attained, the foils create enough lift to raise the hull above the surface and, hence, eliminate the normal resistance encountered by a ship hull in passing through the water.

In the usual case, there are forward and aft foils, both provided with control flaps similar to those used on aircraft. The other essential element is the rudder which pierces or is submerged beneath the surface of the water and is either forward or aft of the craft, depending upon its design. In most hydrofoils, the flaps are used primarily to cause the craft to ascend or descend and to control the craft about its pitch and roll axes; however they can also be used in combination with the rudder to bank the craft about its roll axis during a turn. The flaps are also used to stabilize the craft during movement on water. For example, pitching or rolling motions can be minimized by proper counterbalancing movement of the flaps. A typical control system for hydrofoils is shown, for example, in copending application Ser. No. 302,559, filed Oct. 31, 1972 and assigned to the Assignee of the present application.

In the system described in the aforesaid copending application Ser. No. 302,559, provision is made for sensing the height of the bow of the craft above the surface of the water during foil-borne operation and for producing an electrical signal proportional thereto. This signal is compared with a signal proportional to desired height as determined by the pilot; and if the two signals are not the same, the control flap on the forward foil is adjusted until actual height is equal to desired height. Additionally, a vertical gyro produces a signal proportional to the pitch angle of the craft for controlling both the forward and aft flaps. The arrangement is such that if, for example, the bow of the craft should dip, the forward flap is rotated downwardly and the aft flaps are rotated upwardly to counteract the pitching motion.

Theoretically, it is possible to cause the hydrofoil to take off with a system of the type described above by having the pilot simply set the desired height setting for foil-borne operation while the craft is hull-borne and advancing the craft's throttle. Under these circumstances, comparison of the desired and actual height signals would cause a large error signal which would rotate the forward flap downwardly, causing an excessive drag condition and requiring an extremely high takeoff thrust. At the same time, if a system of this type were employed, the bow of the craft would leave the water in a transition from hull-borne to foil-borne operation at a relatively large pitch angle, causing the aft flaps to deflect downwardly. This, again, would cause excessive drag during takeoff conditions. As a result, the transition from hull-borne to foil-borne operation in many prior art hydrofoils often required special control surface deflections that are used only for this purpose.

These special control surface deflections, in turn, were effected by utilizing special levers or lever settings adjusted by the operator prior to making the transition from hull-borne to foil-borne operation. Needless to say, this forces undesirable operations and procedures upon the pilot which are not directly involved in either foil-borne or hull-borne operation.

SUMMARY OF THE INVENTION

In accordance with the present invention, an automatic takeoff controller is provided for a hydrofoil which obviates the necessity for special levers, lever settings and special pilot procedures involved in making a transition from hull-borne to foil-borne operation. This is achieved by making the necessary adjustments an integral and automatic part of the ship's foil-borne control system.

Specifically, there is provided in accordance with the invention circuitry operable before transition from hull-borne to foil-borne operation is initiated and when the throttle of the craft is at its minimum setting for producing an electrical signal indicative of the hull-borne condition and minimum throttle setting. This signal is then used to automatically position the control flap means on the foils to facilitate rapid takeoff from hull-borne to foil-borne operation with minimum drag.

In a specific embodiment of the invention shown herein, a signal proportional to actual craft height is compared with a signal which varies as a function of the pitch angle of the craft and a reference signal. Assuming that the craft is hull-borne and that the throttle is at its minimum setting, a relay device or the like is actuated to apply bias signals to the forward and aft control servos to automatically position the forward and aft control surfaces or flaps for rapid takeoff under minimum drag conditions. As the craft ascends from the surface of the water and reaches the desired height pitch angle, comparison of the aforesaid three signals will produce a signal which deactivates the relay, whereupon the normal foil-borne control system takes over. Thus, automatic takeoff control is accomplished by monitoring the craft height and pitch angle and inserting an additional command to the flaps or control surfaces when this error indicates that the hull is still in the water. Logic and switching circuits are used to prevent the takeoff controller from functioning inadvertently while foil-borne.

The above and other objects and features of the invention will become apparent from the following detailed description taken in connection with the accompanying drawings which form a part of this specification, and in which:

FIG. 3 is a block schematic diagram of the foil-borne control system for the hydrofoil of FIGS. 1 and 2 and incorporating the automatic takeoff system of the present invention.

Figure 1:
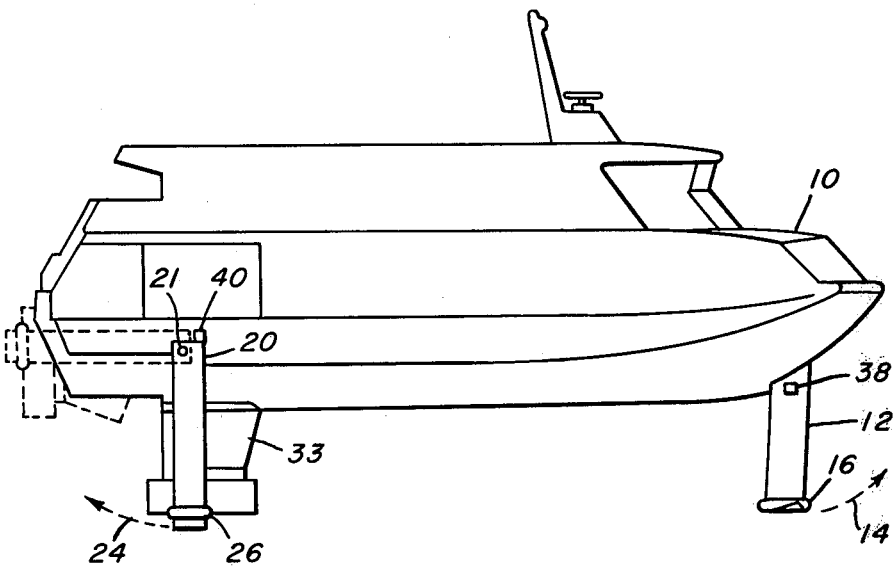
FIG. 1 is a side view of a typical hydrofoil craft with which the control system of the invention can be used.

With reference now to the drawings, and particularly to FIG. 1, the hydrofoil shown includes a conventional hull 10 which can be provided with a propeller or the like and an inboard motor, not shown, in order that it can traverse the surface of the water as a conventional displacement ship. Pivotally connected to the hull is a forward, swiveled strut or rudder 12 which is rotatable about a vertical axis in order to steer the craft in the foil-borne mode of operation. The rudder 12 can be swiveled upwardly in the direction of arrow 14 to clear the surface of the water when the craft is operating as a conventional displacement ship. Carried on the lower end of the rudder 12 is a forward foil 16 (FIG. 2) which carries at its trailing edge control surfaces or flaps 18 which are interconnected and operate in synchronism. Alternatively, the forward foil can be rotated for control.

In the aft position of the craft, struts 20 and 22 are pivotally connected to the hull 10 about an axis 21. The struts 20 and 22 can be rotated downwardly into the solid-line position shown in FIG. 1 for foil-borne operation, or can be rotated backwardly in the direction of arrow 24 and into the dotted-line position shown when the craft operates as a conventional displacement ship. Extending between the lower ends of the struts 20 and 22 is an aft foil 26 which carries, at its trailing edge, two starboard flaps 28 and 30 and two port flaps 32 and 34. Alternatively, the starboard and port foils can be rotated themselves. Each set of starboard flaps and each set of port flaps normally operate in synchronism, the two flaps being used on each side for redundancy and safety purposes.

Carried between the struts 20 and 22 and pivotally connected to the hull 10 about axis 21 is a gas turbine water jet propulsion system 33 which provides the forward thrust for the craft during takeoff and foil-borne operation. It should be understood, however, that a propeller or other type of thrust producing device can be used in accordance with the invention.

With the rudder 12 and struts 20 and 22 retracted, the craft will transit in the hull-borne mode. In the foil-borne mode of operation, both the rudder 12 and its foil 16, and struts 20 and 22 with foil 26, are rotated downwardly into the solid-line positions shown in FIG. 1 and locked in position. In order to become foil-borne, the pilot sets the desired foil depth in a manner hereinafter described and the throttle is advanced. At this time, the automatic takeoff controller, hereinafter described in detail, comes into play. The craft, therefore, accelerates and the hull clears the water and continues to rise until it is stabilized at the commanded foil depth. The craft can be landed by simply reducing the throttle setting, allowing the ship to settle to the hull as the speed decays.

Figure 2:
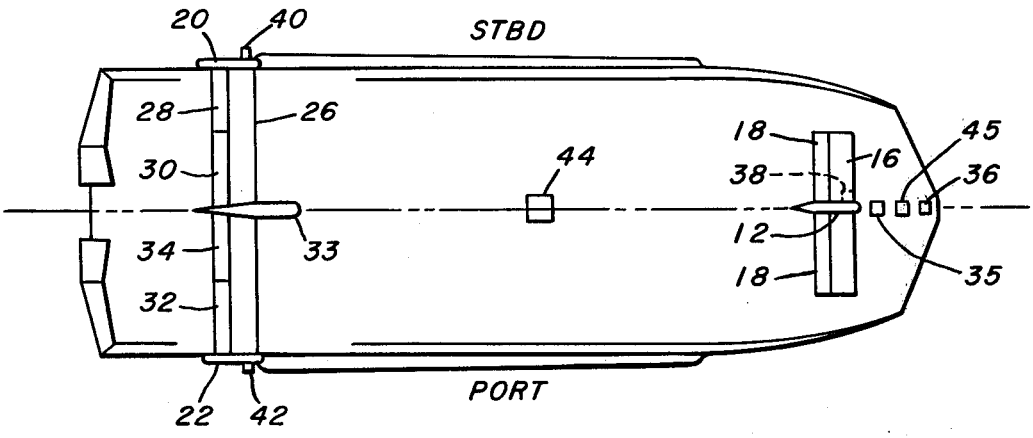
FIG. 2 is a bottom view of the craft shown in FIG. 1.

Mounted on the hull, as shown in FIG. 2 are sensors for producing electrical signals indicative of craft motion. Thus, at the bow of the craft is a height sensor 36 which produces an electrical signal proportional to the height of the bow above the surface of the water during foil-borne operation. Also at the bow of the ship is a forward vertical accelerometer 35 which produces an electrical signal proportional to vertical acceleration. Mounted on the rudder 12 is a lateral accelerometer 38 which, of course, produces an electrical signal proportional to lateral or sideways acceleration of the craft during turning. Mounted on the top of the starboard strut 20 is an aft starboard vertical accelerometer 40; and mounted at the top of the port strut 22 is an aft port vertical accelerometer 42. A vertical gyro 44 is mounted in the craft, preferably near the center of gravity, for producing signals proportional to the angle of the craft with respect to vertical about its pitch and roll axes which are parallel and perpendicular, respectively, to the keel of the craft. Finally, a yaw rate gyro 44 is provided in the forward portion of the craft. The accelerometers and gyros will sense motions of the craft about its roll, pitch and yaw axes.

Any movement about the roll axis will be sensed by the vertical gyro 44 as well as the aft accelerometers 40 and 42. The gyro 44 will produce an output signal proportional to the amount or degree of roll; while the accelerometers 40 and 42 will produce signals proportional to the angular acceleration about the roll axis. Any movement about the pitch axis will be sensed by the vertical gyro 44 as well as both the forward and aft accelerometers 35, 40 and 42. Finally, any movement about the yaw (i.e., vertical) axis will be sensed by the yaw rate gyro 45 as well as the lateral accelerometer 38.

In the normal control of the hydrofoil shown herein, the height of the hull above the water is controlled solely by the forward flap 18. In order to raise the hull during foil-borne operation, the forward flap is caused to rotate downwardly, thereby increasing the lift afforded by the forward foil 16. In order to eliminate or minimize the pitching motions about the pitch axis, both the forward and aft flaps are employed. However, the forward and aft flaps operate in opposite directions to correct any pitch condition. For example, if the bow of the craft should dip, the forward flap 18 will be rotated downwardly; while the aft flaps 28–32 will be rotated upwardly to produce a moment counterbalancing that pitching movement caused by waves or the like. Compensation for movement about the roll axis is achieved by the aft flaps 28–32 and the rudder 12; however in this case the starboard flaps move in a direction opposite the port flaps to correct for any undesired rolling motion. In turning the craft, the aft flaps are initially positioned to cause the craft to bank about its roll axis; whereupon the rudder 12 is rotated to follow through. This gives a much better and smoother turning action since the correct roll inclination is achieved before any substantial turning of the craft occurs via the rudder.

The particular hydrofoil shown herein and the control system about to be described are the subject matter of the aforesaid copending application Ser. No. 302,559, filed Oct. 31, 1972 and assigned to the Assignee of the present application. As was explained above, however, the invention can be used with any hydrofoil control system, the essential feature being the inclusion of an automatic takeoff controller which causes the craft to rise from a hull-borne to a foil-borne condition automatically and with minimum drag caused by the flaps or control surfaces.

In the particular control system of FIG. 3, the signal from the height sensor 36 proportional to actual height is compared with the desired height signal from the pilothouse depth control 68 on lead 66 in a depth error amplifier 74. If the two signals fed to the amplifier 74 are not the same, then a signal is developed on lead 76 and applied to a forward flap servo system 78 which causes the forward flap 18 to rotate downwardly or upwardly, depending upon whether the hull should rise or descend. When it is desired to turn the craft about its yaw axis, a signal on lead 70 derived from the helm 72 and proportional to helm position is applied to a roll derivative amplifier 80 where it is compared with a signal on lead 82 from vertical gyro 44 proportional to the roll angle about the yaw axis relative to vertical.

At the beginning of a turn, and assuming that the water through which the hydrofoil is traveling is smooth, the signal on lead 82 will be zero, or substantially zero. The roll derivative amplifier 80 compares the signal on lead 82 with that on lead 70; and assuming that the two are not the same, as is the case for the conditions just described, then an output signal appears at the output of amplifier 80 and is applied to the inboard and outboard port flap servos 84 and 86. At the same time, it is applied in an inverted form to the inboard and outboard starboard flap servos 88 and 90. The result, of course, is that one set of aft flaps will rotate downwardly while the other set rotates upwardly to cause the craft to bank about its roll axis. This action will continue until the angle of roll as sensed by the gyro 44 is such as to generate a signal which nulls out the helm signal on lead 70.

However, at the same time, the signal on lead 82, proportional to roll angle, is also applied to a rudder servo 92. This causes the rudder 12 to rotate after the craft begins to bank about its roll axis, causing the craft to turn in the direction to which the craft has been banked as described in the aforesaid copending application Ser. No. 302,559. Thus, if the craft banks to the right in response to a signal from helm 72, the rudder will thereafter rotate to steer the craft to the right. This gives a much smoother turn for all sea conditions encountered with a minimum of acceleration forces on the passengers and crew.

As the craft turns, the yaw rate gyro 45 will produce a signal on lead 94 proportional to the rate of turning about the yaw axis; and this is utilized in the rudder servo 92 to limit the rate of turning. The same is true of forward lateral accelerometer 38 which produces a signal on lead 96 proportional to lateral acceleration. Of course, after the desired turn is executed and the helm 72 rotated back to its center or null position, the signal on lead 70 decreases back to zero; whereupon the positions of the aft flaps are reversed to cause the craft to come back up into a vertical position about its roll axis. At this point, the output of the vertical gyro 44 on lead 82 decreases to zero, the rudder 12 is centered, and the craft is again upright.

The remaining control actions are primarily for the purpose of eliminating or minimizing undesirable pitching and rolling actions. Thus, the forward accelerometer 35 senses acceleration, either upward or downward, at the bow and produces an electrical signal for controlling the forward flap 18 to counteract upward or downward acceleration. The output of the forward accelerometer 35, however, is combined in an integral amplifier 100 with a signal proportional to the roll signal squared as derived from circuit 98 before the combined signal is applied to the forward flap servo 78. This is for the reason that during a turn and while the craft is being banked about its roll axis, and during normal rolling action in heavy seas, the rolling movement produces a component of vertical acceleration which must be taken into consideration.

A signal proportional to the angle of the craft about the pitch axis is derived from vertical gyro 44 on lead 102. This is applied to a pitch derivative amplifier 104 which produces an output signal which varies as a function of pitch The output of the pitch derivative amplifier 104 is then applied to all of the aft flap servos and is also applied in an inverted form to the forward flap servo 78 to achieve differential control. This signal is used for stability augmentation, ride smoothing in a seaway, and automatic pitch trim control.

Assuming that the craft is rolling about its roll axis, a signal will be derived on lead 82 which is again applied to the roll derivative amplifier 80. The signal on lead 82 under these circumstances will first increase in one direction or polarity, then recede back to zero and increase in the other direction or polarity and again recede back to zero as the craft rolls from side-to-side. This again produces at the output of the roll derivative amplifier a signal which varies as a function of both the roll angle as well as the rate of change of roll angle. The signal is applied to the aft port and starboard servos so as to achieve differential action that counteracts the rolling movement. In other words, a signal of one polarity is applied to the port flap servos; while a signal of inverted polarity is applied to the starboard flap servos to achieve rotation of the respective port and starboard flaps in opposite direction to counteract a rolling motion.

The output of the port vertical accelerometer 42 is applied to both the inboard and outboard port flap servos 84 and 86 and acts to vary the aft port flap position to counteract any vertical or heave acceleration on the port side. Similarly, the output of the starboard vertical accelerometer 40 is applied to both the inboard and outboard starboard flap servos 88 and 90 to achieve the same action and counteract vertical accelerations on the starboard side of the craft. The servo system for the various flaps can take various forms, one typical form being shown in the aforesaid copending application Ser. No. 302,559. In essence, each comprises a servo amplifier which actuates a servo valve for controlling a flap actuator. The position of the flap is then sensed by a transducer to produce a feedback signal which is fed back to the servo amplifier whereby an error signal to the servo amplifier will cause the flap to deflect to a desired position; whereupon the input error signal and the feedback signal from the transducer are the same and the corrective action is terminated.

If an attempt is made to take off from the hull-borne condition with the system of FIG. 3 by simply setting the depth by control 68 to the desired foil-borne height while advancing the craft throttle 110, a large error signal at the output of depth error amplifier 74 would cause the forward flap servo 78 to rotate downwardly into its extreme position, thereby creating a very high drag configuration. Furthermore, as the bow of the craft ascends out of the water, the pitch output of the vertical gyro 44 will attempt to rotate the forward flap upwardly while rotating the aft flaps downwardly. In point of fact, it is desired to rotate both the forward and aft flaps at takeoff near preselected positions so as to minimize drag.

In accordance with the present invention, an automatic takeoff controller is incorporated into the system of FIG. 3 for accomplishing the foregoing desirable result. It includes a relay 112 having a first pair of normally-open contacts 114 and a second pair of normally-open contacts 116. When contacts 114 and 116 close, signals are applied to leads 118 and 120, respectively, to cause the forward flap 16 as well as the aft flaps 26 to assume the correct positions for takeoff with minimum drag conditions. That is, the signals on leads 118 and 120 are combined with all other signals which might be applied to the flap servos.

The relay 112 is controlled by comparing three signals. The actual height signal from the height sensor 36 is amplified in amplifier 124 and applied via lead 126 to summing point 122. Similarly, the pitch angle signal from vertical gyro 44 is amplified in amplifier 130 and applied via lead 128 to the same summing point 122. The error signal on lead 141 derived by comparison of the height and pitch signals at summing point 122 is then compared in comparator 132 with a reference signal on lead 140 from power supply 134.

When the craft is hull-borne and prior to takeoff, the signal from the summing point 122 on lead 141 will be much smaller in magnitude than that on lead 140. As a result, the comparator 132 will energize relay 112, assuming that switch 136 is closed. The switch 136 is connected to the craft throttle 110 and will be closed when the throttle is at its minimum setting prior to takeoff with the craft power plant idling. Thus relay, 112 can be energized when, and only when, the throttle is at its minimum position prior to takeoff. This minimum position is never reached when the craft is foil-borne. Once the relay 112 is energized, and assuming that the output of comparator 132 persists, the relay 112 will be held energized through contacts 138 even though the switch 136 opens when the throttle is advanced during the takeoff procedure.

It is necessary to compare the pitch and actual height signals at summing point 122 since, as shown in FIG. 2, the height sensor 36 is at the bow of the craft. During takeoff, the bow rises faster than the stern with the craft at a large pitch angle. The takeoff procedure is not completed until the stern rises also and the pitch angle decreases. If only the actual height signal were used, it would not be possible to determine when the stern had risen to the point where the takeoff procedure was completed. However, by combining the height and pitch signals at summing point 122 in subtractive relationship, the error signal on lead 141 applied to comparator 132 is maintained at a low level until the stern ascends and the ptich signal on lead 128 drops in magnitude. Thus, during a normal takeoff procedure, the bow will rise initially, thereby producing a large amplitude signal on lead 126. At the same time, however, a large pitch signal will be produced on lead 128 which has a tendency to cancel the signal on lead 126 such that the error signal on lead 141 applied to comparator 132 remains low and the relay 112 remains energized. However, as the takeoff proceeds and the stern rises, the pitch signal on lead 128 decreases and the error signal on lead 141 increases to the point where the comparison in comparator 132 is such as to deenergize relay 112 at the completion of takeoff.

To summarize, relay 112 will remain energized to bias the forward and aft flaps to the correct positions until the craft has ascended to the desired height. Under these circumstances, the signal from summing point 122 on lead 141 as compared in comparator 132 with the signal from power supply 134 will no longer produce a signal to energize relay 112. Consequently, the relay 112 becomes deenergized, the contacts 114 and 116 open, and normal foil-borne operation of the type described above takes over. The automatic takeoff controller cannot again be initiated until the craft settles back down to a hull-borne mode of operation and the throttle is completely retracted to its minimum setting.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In a control system for a hydrofoil craft having forward and aft foils, the combination of control surface means on the forward foil, control surface means on the aft foil, power plant throttle means for said craft, means connected to said throttle means and operable while said craft is hull-borne with said throttle means at its minimum speed setting for producing an electrical signal indicative of said hull-borne condition, servo systems for the forward and aft control surface means, means including a relay device responsive to said electrical signal for actuating said servo systems to position said control surface means prior to and during takeoff to facilitate rapid takeoff from hull-borne to foil-borne operation with minimum drag, and apparatus including a height sensor for disabling said last-named means when the craft reaches a predetermined foil-borne height.

2. The control system of claim 1 wherein said apparatus for disabling includes a pitch angle gyro and wherein the last-named means is not disabled until the craft has reached a predetermined pitch angle while foil-borne.

3. The control system of claim 1 including means for producing a first electrical signal proportional to actual foil-borne height, means for producing a second electrical signal proportional to pitch angle, and means for comparing said first and second electrical signals to produce a third electrical signal for controlling said disabling apparatus.

4. The control system of claim 1 including means for preventing actuation of said relay device to apply said bias to the servo systems except when the throttle means is at its minimum setting.

* * * * *